United States Patent [19]

Allmon

[11] Patent Number: 4,962,973

[45] Date of Patent: Oct. 16, 1990

[54] PORTABLE RECYCLE CONTAINER ASSEMBLY

[76] Inventor: Bruce M. Allmon, Rte. 2, Box 347-H, Marthasville, Mo. 63357

[21] Appl. No.: 416,592

[22] Filed: Oct. 3, 1989

[51] Int. Cl.[5] ..... A47B 88/00

[52] U.S. Cl. ..... 312/325; 312/311; 312/274; 312/275

[58] Field of Search ..... 312/270, 274, 275, 250, 312/319, 325, 311; 220/1 T, 22

[56] References Cited

U.S. PATENT DOCUMENTS

| | | | |
|---|---|---|---|
| 2,095,811 | 10/1937 | Goulooze | 312/274 |
| 2,285,159 | 6/1942 | Hanson et al. | 312/325 X |
| 2,597,722 | 5/1952 | Goldberg | 312/274 |
| 3,720,346 | 3/1973 | Cypher . | |
| 3,904,218 | 9/1975 | Kostic . | |
| 4,335,828 | 6/1982 | Robinson et al. | 220/1 T X |
| 4,585,283 | 4/1986 | Redmon et al. | 312/250 |
| 4,662,690 | 5/1987 | Genereaux | 312/274 X |
| 4,693,525 | 9/1987 | Shinoto | 312/325 X |
| 4,739,894 | 4/1988 | Pender . | |
| 4,765,579 | 8/1988 | Robbins et al. | 220/1 T |
| 4,801,034 | 1/1989 | Sandomeno . | |
| 4,867,328 | 9/1989 | McCarthy | 220/22 X |
| 4,870,315 | 9/1989 | Neuhaus | 312/275 X |
| 4,874,111 | 10/1989 | Heller | 220/22 X |

OTHER PUBLICATIONS

Consolidated Plastics Company, Inc. 1989 catalog, pp. 34, 37, 39, 40, 41 and 63.

*Primary Examiner*—Joseph Falk

*Attorney, Agent, or Firm*—Rogers, Howell & Haferkamp

[57] ABSTRACT

A transportable recycle container assembly includes a portable container mounted on rollers and having a top opening inclined toward the front of the container. A hinged top is provided to selectively cover the opening of the container, and to be opened upward to provide access to the interior of the container. The container includes mutually opposed channels in its interior side walls for receiving divider panels inserted into the container to divide the container interior into two or more separate compartments. The assembly also includes an enclosure for housing the container. Automatic opening cam mechanisms are provided in the interior of the enclosure and are responsive to the opening and closing of doors at the front of the enclosure to open and close the hinged top of the container, respectively. The container also includes one or more ring members that are inserted into and seat in the top opening or openings of the container, and hold and suspend conventional refuse bags from the top opening of the container.

22 Claims, 3 Drawing Sheets

FIG. 1.
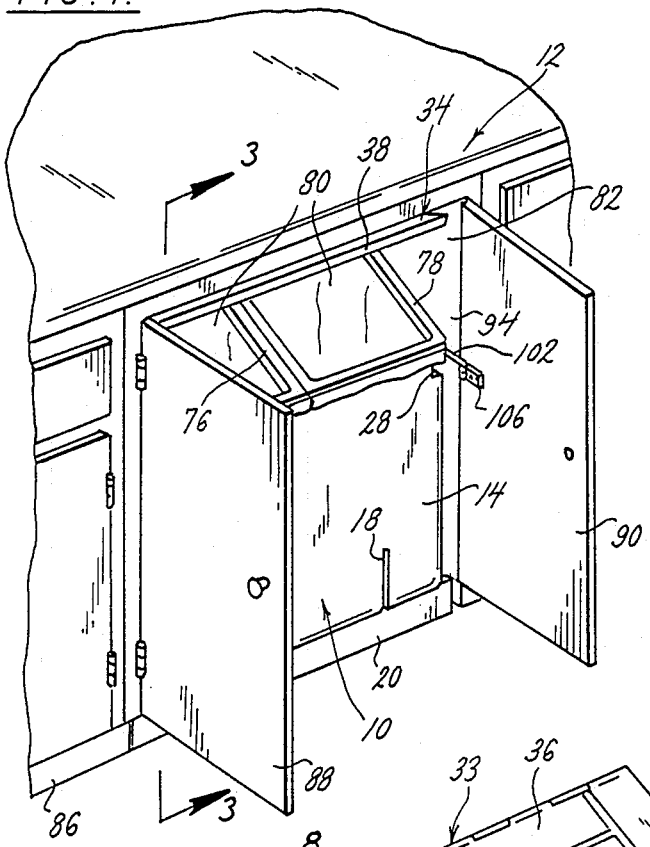
FIG. 7.
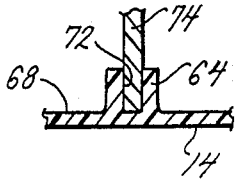
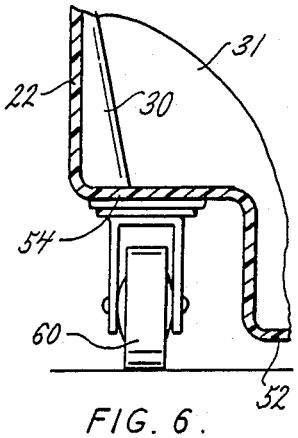
FIG. 6.
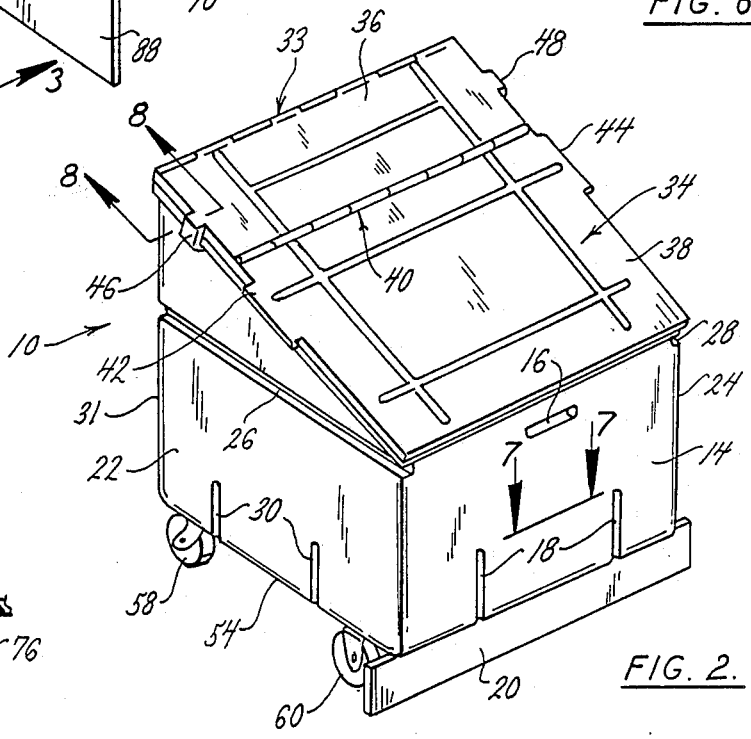
FIG. 2.
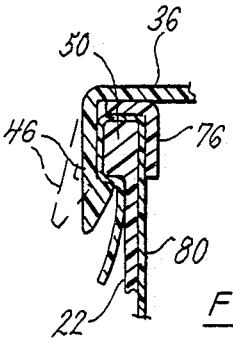
FIG. 8.

PORTABLE RECYCLE CONTAINER ASSEMBLY

BACKGROUND OF THE INVENTION (1) Field of the Invention

The present invention pertains to a transportable recycleable refuse container assembly, in particular, a rolling covered container that is adapted to be rolled into and out of an enclosure area, where a door enclosing the enclosure is connected to a cam assembly that automatically opens the covering of the container in response to opening of the door of the enclosure, and automatically closes the covering of the container in response to closing the door.

(2) Description of the Related Art

Conventional refuse containers are known to have manually opened and closed lid coverings along with rollers to facilitate the transportation of the container. Containers of this type are used both in the home and in work environments, and are commonly used to store refuse to be later disposed of or recycled A common disadvantage found in the use of this type of container is that one or more containers are needed to store the separated refuse to be disposed of and the refuse that is to be later recycled. In both the home and work environments, a separate container is required to store disposable refuse and recycleable refuse, and often still further containers are required to store different types of recycleable refuse such as aluminum and glass. Providing a separate container to store the separate types of refuse presents the problem of the containers occupying a substantial portion of the space available in the home or work place where the containers are kept.

The transportable recycle container assembly of the present invention overcomes the above disadvantages of the prior art refuse containers by providing a rolling recycle container that is capable of being subdivided into a multiple of separate interior compartments to store separated refuse that is to be later disposed of or recycled. The transportable recycle container assembly is also provided with an enclosure area into which the container is inserted to remove the container from the work area in the home or work place where the container is kept. The door or doors that permit access to or enclose the enclosure area are provided with a linkage mechanism that automatically opens and closes the hinged lid of the cōntainer in response to the respective opening and closing of the door or doors of the enclosure area containing the container.

SUMMARY OF THE INVENTION

The transportable recycle container assembly of the present invention comprises both a transportable refuse container and an enclosure for the container.

The portable container includes four interconnected vertical walls and a bottom that are arranged in a box-like configuration. The top opening of the container is inclined from a back wall toward a front wall of the container. The side walls of the container each have a horizontal channel extending across their exterior surface. A hinged lid covers the top opening of the container. The lid comprises a first hinge extending from side to side across a midportion of the lid that enables a front section of the lid to pivot upward about the first hinge and open a forward section of the container top opening. A second hinge between the back edge of the lid and the top edge of the container back wall enables the front and a back sections of the lid to pivot upward and back together about the second hinge to completely uncover the top opening of the container.

The container is mounted on four rollers, two of which have casters to facilitate manipulating the container. A toeboard extends downward from a lower edge of the container's front wall in front of the rollers to obscure the rollers from view from the front of the container.

One or more pairs of mutually opposed vertical channels are provided on the interior surface of the container's front and back walls. The channels receive divider panels that are inserted into the channels to divide the interior of the container into two or more separate compartments, and are pulled out of the channels to combine separate compartments of the container into one larger interior volume.

The enclosure that houses the container also has a general box-like configuration and is dimensioned slightly larger than the container to permit the insertion and removal of the container into and from the enclosure. In a preferred embodiment, the enclosure includes two side walls, a back wall, and a top work surface. The side walls are dimensioned to permit the container to be rolled into the enclosure area defined by the walls and work surface. The open front of the enclosure is selectively closed and opened by a hinged door or doors. Positioned on the side walls on opposite sides of the front opening are mutually opposed channel slide members. The slide members are separated a predetermined distance and engage in the horizontal channels on the exterior surface of the container side walls as the container is inserted into the enclosure opening to orient and hold the container in a desired position relative to the enclosure.

Pivotally secured to one or both of the slide members is a container lid opening assembly. Each lid opening assembly comprises a cam member pivotally mounted on a slide member, and a connecting rod pivotally connected between the cam member and the interior surface of a hinged door that opens and closes the front opening of the enclosure. The pivoting cam and the connecting rod are arranged so that, when the door of the enclosure is opened, the connecting rod is pulled forward from the pivoting motion of the door. The forward movement of the rod pulls the pivoting cam forward and upward. The cam pivots upward about a pivot pin connecting the cam to the channel slide member, and a cam surface of the cam engages a wing member on the side of the front section of the container lid, causing the front section of the lid to pivot open about the first hinge connection. When the door of the enclosure is closed, the connecting rod causes the pivoting cam to pivot backward and down about the pivot pin, causing the cam surface of the cam to slide across the wing member of the lid, resulting in the front section of the lid pivoting downward about the first hinge and returning to its closed position covering the forward section of the top opening of the container.

In an alternate embodiment, the container is provided with two separate left and right side front lid sections, with each section pivoting about the first hinge and covering one half of the forward section of the top opening, and covering one of a pair of separate compartments defined in the interior of the container by an inserted divider panel. With the container having a pair of front lid sections, a pair of enclosure doors and a pair of lid opening assemblies are also provided. The pivoting cam member of each pair is pivotally mounted on one of the opposed slide members of the enclosure and engages a wing member on the side of each front lid section to open and close the left and right side front lid sections in response to the opening and closing of the respective left and right enclosure doors.

The enclosure assembly may be arranged as one component of a plurality of cabinet components of a kitchen cabinet assembly with the door or doors of the enclosure matching the doors of the other cabinet components. The toeboard at the bottom of the container front wall can be covered with a material matching the baseboard molding of the kitchen cabinet assembly, and the top surface of the enclosure can be constructed from a material matching the kitchen counter top or be an extension of the kitchen counter top.

BRIEF DESCRIPTION OF THE DRAWINGS

Further objects and features of the present invention are revealed in the following detailed description of the preferred embodiment of the invention and in the drawing figures wherein:

FIG. 1 is a perspective view of the front of the enclosure assembly of the present invention with the transportable recycle container inserted in place in the enclosure;

FIG. 2 is a perspective view of the transportable recycle container of the present invention;

FIG. 6 is an elevation view in section of the detail of a swivelling roller of the recycle container viewed along line 6—6 of FIG. 3;

FIG. 7 is a plan view in section showing the detail of a divider panel channel on the interior surface of the front wall of the recycle container as viewed along line 7—7 of FIG. 2;

FIG. 8 is an elevation view in section of the detail of a connection between the back section of the lid cover and the side wall of the recycle container as viewed along line 8—8 of FIG. 2.

DETAILED DESCRIPTION OF THE PREFERRED EMBODIMENT

Figure 3:
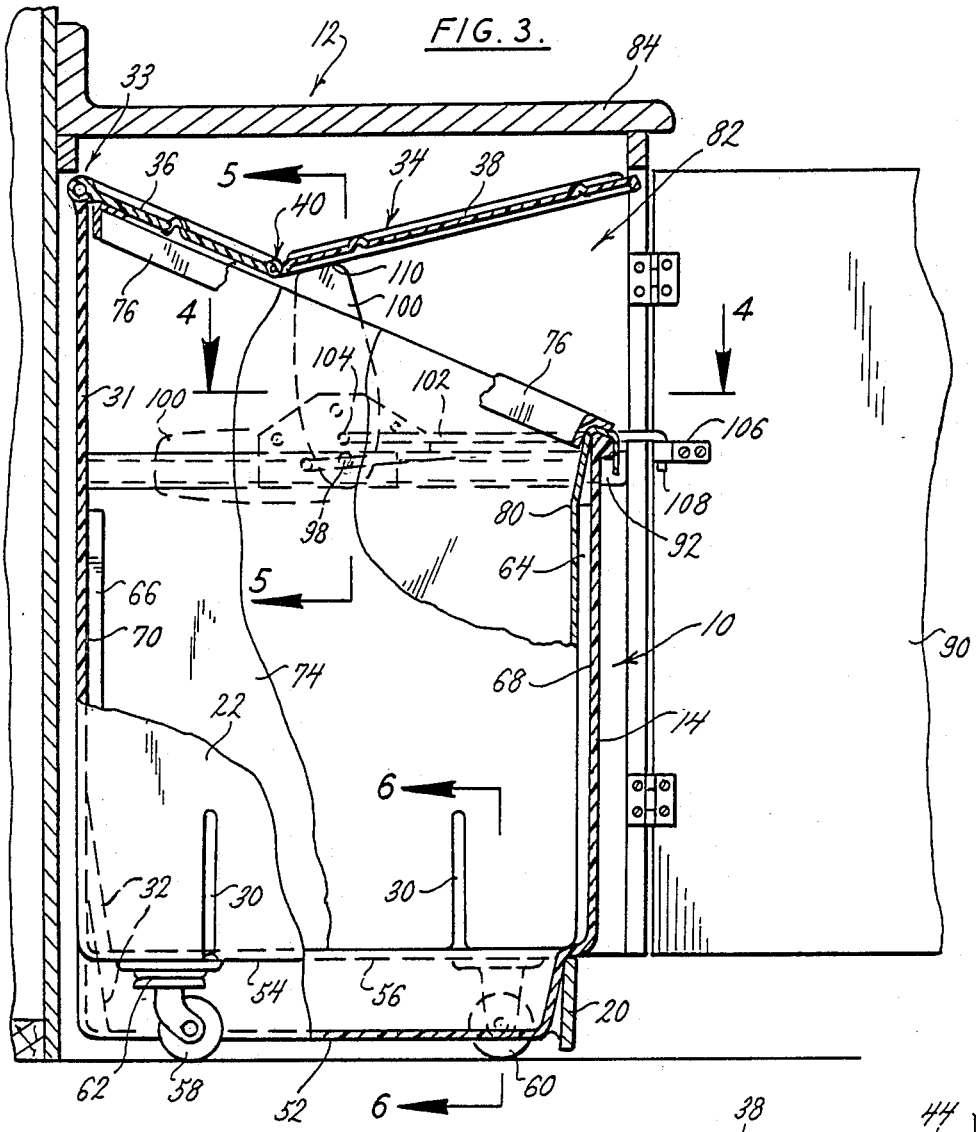
FIG. 3 is a side elevation view in section of the transportable recycle container inserted in place inside the enclosure assembly.

FIG. 1 shows a perspective view of the transportable recycle container 10 and the enclosure assembly 12 of the present invention with the container inserted in the interior of the enclosure.

The container 10 includes four side walls and an interconnected bottom, and in a preferred embodiment is molded as a plastic unitary assembly. The container front wall 14 is provided with a recessed handle 16 to facilitate manipulation of the container when it is being transported from one location to another. The front wall also includes multiple of web members 18 that provide additional rigidity to the front wall, and a toeboard or kick plate 20 that is provided to mount a piece of base molding that matches the base molding of a kitchen cabinet assembly when the present invention is used in a home and is incorporated as part of the kitchen cabinet assembly.

The left and right container side walls 22, 24 as viewed in FIG. 2 are each provided with a slide channel 26, 28, respectively. Each of the side walls also have web members 30 providing additional rigidity to the side walls.

The container back wall 31 has the same horizontal dimensions of the front wall 14, but the vertical dimensions are slightly larger than those of the front wall. The back wall is also provided with a recessed handle (not shown) and web members 32 to provide additional structural rigidity to the wall.

A detachable first hinge assembly 33 of a type known in the art is provided across the top edge of the container back wall 31. The first hinge assembly 33 pivotally connects a container lid 34 with the container, and is also arranged so that it may be disassembled to permit the complete removal of the lid 34 from the top of the container.

The lid itself is comprised of a rear member 36 and a forward member 38 that are pivotally connected together by a second hinge 40. Wing members 42, 44 extend from the left and right edges of the forward lid member 38, as viewed in FIG. 2. The wing members provide a sliding surface that enables the automatic opening and closing of the forward lid member 38 in a manner to be described later. The rearward lid member 36 comprises left and right attachment clips 46, 48 on the left and right side edges of the member, as viewed in FIG. 2. The attachment clips are arranged to be pressed over the outer upper edges 50 of the side walls 22, 24 to deform outward over the upper edges and then snap in place around the edges 50, as shown in FIG. 8. The clips secure the rearward lid member 36 over a rear portion of the top opening of the container, thereby securing the forward member 38 of the lid over the remaining front portion of the top opening of the container by its second hinge connection 40 with the rearward lid member 36.

With the detachable hinge assembly 33 securing the rearward lid member 36 to the top edge of the back wall 31, and the left and right attachment clips 46, 48 pressed down and snapped in place over the upper edges 50 of the respective left and right container side walls 22, 24, the rearward lid member 36 is held securely in place over the rear portion of the top opening of the container. This connection permits the pivoting of the forward lid member 38 upward and back about the second hinge 40 to permit access to the interior of the container, and pivoting of the lid member 38 forward and down to close the top opening of the container.

By unsnapping the left and right attachment clips 46, 48 from their connections with the upper edges 50 of the container side walls, both the rear lid member 36 and the forward lid member 28 may be pivoted back about the detachable hinge assembly 33 and suspended over the container back wall 31 to completely open the top of the container. Alternatively, the detachable hinge 33 can be disassembled to completely remove the lid 34 from the container 10.

The bottom 52 of the container is provided with left and right horizontal bottom ledges 54, 56 on opposite sides of the container. Pairs of rollers 58, 60 are mounted on each of the bottom ledges, as seen in FIGS.

2 and 3, with one roller 58 of each pair of rollers being mounted by a swivel connection 62. The recessed ledges on the left and right sides of the container provide space beneath the container for mounting the rollers without substantially reducing the interior volume of the container. The middle portion of the container bottom 52 between the left and right side ledges extends downward from the ledges a vertical distance slightly less than the vertical height of the roller assemblies, as seen in FIG. 6, to provide additional interior volume to the container.

The interior of the container is provided with vertical channels 64, 66 in mutually opposed positions on the interior surfaces 68, 70 of the front and back container walls 14, 31, respectively. The container may be provided with one pair of mutually opposed channels to divide the container into two separate compartments in a manner to be explained, or in an alternative embodiment, the container may be provided with two pairs of mutually opposed vertical channels to divide the container interior into three separate compartments. The vertical channel members define a vertical slot 72, as seen in FIG. 7, on opposite sides of the container interior. A divider panel 74 is dimensioned to be received in the opposed slots of the vertical channel members and supported in an upright position extending across the interior of the container, dividing the container interior into two separate compartments. In the preferred embodiment, there is one pair of opposed vertical channel members that receive a divider panel 74, dividing the interior of the container into two separate compartments. In the alternate embodiment, the container is provided with two pairs of mutually opposed channel members that each receive a divider panel to divide the interior of the container into three separate compartments.

The container is also provided with first and second ring members 76, 78. The ring members are dimensioned to be inserted into and press-fit in a seated position in the top openings of the container compartments defined by the upper edges of the four side walls of the container and the upper edge of the divider panel 74 inserted into the opposed vertical channel members 68, 70 of the container. The ring members 76, 78 are dimensioned so that an appropriately sized conventional plastic refuse bag 80 may be inserted into one or both of the two compartments defined in the interior of the container by the divider panel 74, with the bag being held open and suspended upright in the compartment by a ring member inserted into the top opening of the bag and press-fit into place in its seated position at the top of the compartment opening. The ring members are so designed so that two separate conventional refuse bags may be held open and suspended, one in each of the separate compartments defined in the interior of the container by the divider panel. In the three compartment embodiment, three rings are dimensioned to hold open and suspend three refuse bags in the three compartments. In both embodiments, a single, larger ring member (not shown) is also provided that is inserted into the top opening of the container with the divider panels removed, and press-fit in its seated position at the top of the opening to hold open and suspend a single refuse bag in the container.

In using the above defined container, a user can divide the interior of the container into two or three separate compartments to store recycleable refuse in one compartment and refuse to be disposed of in a second separate compartment, or the user can remove the divider panel or panels from the interior of the container and use the entire interior of the container for storing one type of refuse. With the refuse bag or bags in place, the container may be inserted into the enclosure or transported about by rolling the container on its rollers. When refuse is to be stored in the interior of the container, the user need only lift open the forward member of the lid 38 to deposit the refuse within the container. When the bag or bags are filled, the operator may roll the entire container to a disposal site, completely open the top of the container by pivoting the lid 34 up over the first hinge 33 until it hangs down over the back wall 31 of the container and then remove the ring member or members from the top opening of the container to remove the refuse bags for disposal.

The present invention also comprises an enclosure assembly to house the transportable recycle container and remove the container from the work area in the home or work place. The enclosure assembly 12 is shown in FIGS. 1 and 3, and includes an open cavity 82 beneath a horizontal work surface 84, the cavity having dimensions sufficiently large to accommodate the insertion of the entire transportable recycle container 10.

As can be seen in FIGS. 1 and 3, the enclosure assembly 12 may be provided beneath a kitchen counter top in the home or beneath a work bench surface in the work place. When used in the kitchen of a home, the toeboard or kick plate 20 may be covered with a baseboard molding that matches the baseboard molding 86 of the kitchen decor. As can be seen in FIG. 1, with the enclosure doors 88, 90 closed, the container 10 will be concealed from view from the work area. As can be seen in FIG. 3, with the transportable recycle container inserted into the enclosed area, the slanted top of the container provides ample room for the forward lid member 38 to be pivoted upward about the second hinge 40 to permit access to the compartments contained in the container.

Figure 4:
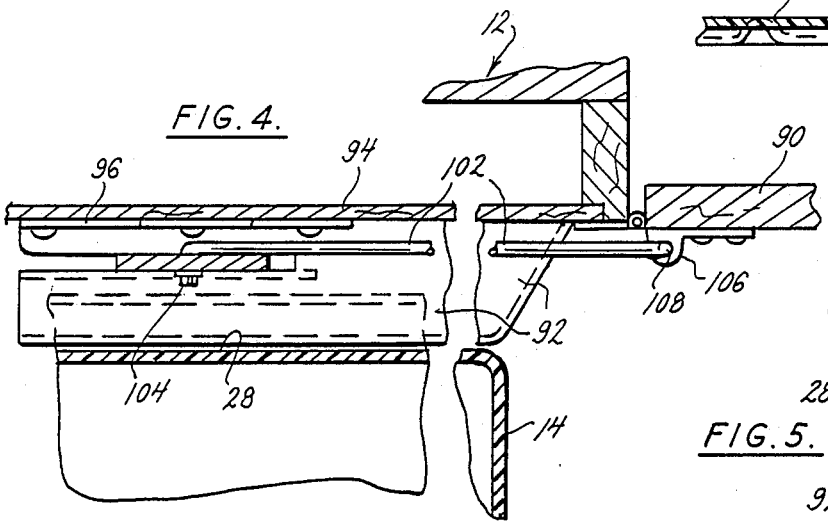
FIG. 4 is a plan view of the detail of a horizontal container channel, an enclosure channel slide member, and a pivoting cam and its linkage connection with an enclosure door.

The enclosure assembly is also provided with a mechanism for automatically lifting the forward lid member 38 to open the container when a front door 88, 90 of the enclosure is opened. The mechanism includes a pair of mutually opposed channel slide members 92 positioned horizontally on opposite sides of the enclosure. The slide members are spaced apart a sufficient distance to permit the insertion of the container 10 between the slide members. As the container 10 is rolled backward into the enclosure cavity 82, the left and right slide members 92 engage in and slide through the respective left and right slide channels 26, 28 in the side walls of the container and position the container square in the enclosure with respect to the enclosure's sides and back. The slide members also serve to hold the container 10 in the enclosure cavity 82 in its proper orientation relative to the lid opening mechanicsm. The slide members may be secured to an interior surface of the side enclosure walls 94 by a mounting bracket 96, as seen in FIGS. 3 and 4.

Figure 5:
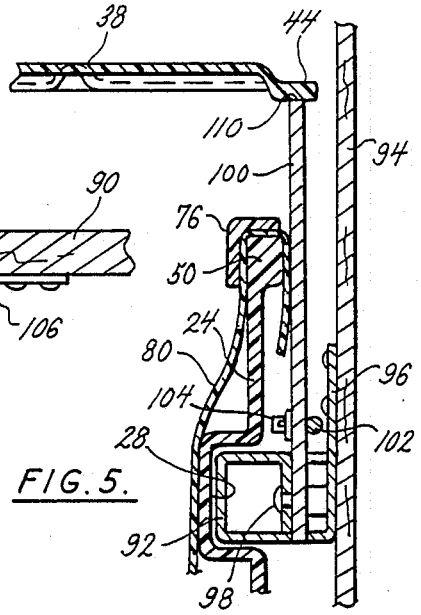
FIG. 5 is an elevation view in section of the recycle container with the front section of the container lid being held open by the pivoting cam member as viewed along line 5—5 of FIG. 3.

A pivot pin 98 extends from the mounting bracket 96 into the cavity 82 of the enclosure assembly. A cam member 100 is pivotally mounted on the pivot pin 98, as seen in FIGS. 3 and 5. The cam member 100 is arranged to pivot between a first horizontal position shown in phantom lines in FIG. 3, and a second vertical position also shown in FIG. 3.

A linking rod 102 is pivotally connected to the cam member 100 by a pin 104 at a first end of the rod. The second end of the rod is pivotally connected to a bracket 106 mounted on the interior surface of the enclosure door 90 by a pivot pin 108 at the second end of the rod. As can be seen in FIG. 3, when the enclosure door 90 is closed, the linking rod 102 is pushed to the left by the door, as viewed in the Figure, causing the rod to push against the pivoting cam member 100 causing it to pivot counterclockwise and downward about the pivot pin 98 to its horizontal position shown in phantom lines. When the enclosure door 90 is opened, the linking rod 102 is pulled to the right by the door, as viewed in the Figure, causing the rod to pull on the pivoting cam member 100 causing it to pivot clockwise and upward about the pivot pin 98 to its vertical position shown in FIG. 3. When the door 90 is opened, the cam member 100 is pivoted clockwise about the pin 98 and a cam sliding surface 110 on the edge of the cam comes into sliding engagement with the under side of the wing member 44 provided at the side edge of the container lid. As the cam member 100 continues to pivot upward with the opening of the door 90, the sliding engagement of the cam surface 110 with the under side of the wing member 44 causes the cam to push upward on the wing member 44, resulting in the forward lid member 38 pivoting about the second hinge 40 and being automatically raised by the pivoting cam 100.

With the door 90 in its fully opened position, the relative positions of the container, the pivoting cam member 100, and the container forward lid member 38 are substantially as shown in FIG. 3. In this position, the pivoting cam 100 holds the forward lid member 38 open to provide access to the interior compartments of the container. When the door is closed, the linking rod 102 is pushed to the left by the door, as viewed in FIG. 3, and the cam member 100 is pushed by the rod and rotates counterclockwise about the pivot pin 98 downward to its substantially horizontal position shown in phantom lines in FIG. 3. The downward movement of the pivoting cam member 100 causes the forward lid member 38 to return to its closed position covering the top opening of the separate compartments of the container.

With the above described automatic container lid opening mechanism provided in the enclosure cavity 82, it can be seen that the forward lid member 38 will be automatically raised to provide access to the interior compartments of the container when the enclosure doors 88, 90 are opened. Although only one automatic lid opening mechanism is shown in FIG. 3, it should be understood that an additional lid opening mechanism may be provided on the left side of the enclosure cavity 82, as viewed in FIG. 1. The additional lid opening mechanism would be operated by the opening and closing of the left enclosure door 88 to respectively lift and lower the forward lid member 38 of the transportable recycle container in the same manner as the opening mechanism on the right side of the enclosure cavity. In this manner, the forward lid member 38 may be raised to provide access to the interior of the container by opening either the left side or right side doors of the enclosure.

In an alternate embodiment, the transportable recycle container is dimensioned to be inserted into an enclosure that is enclosed by only one door. In this embodiment, the forward lid member 38 would be opened by an automatic lid opening mechanism positioned adjacent the container and operating in response to the opening of the single door in substantially the same manner as described with reference to the double-door enclosure.

Figure 9:
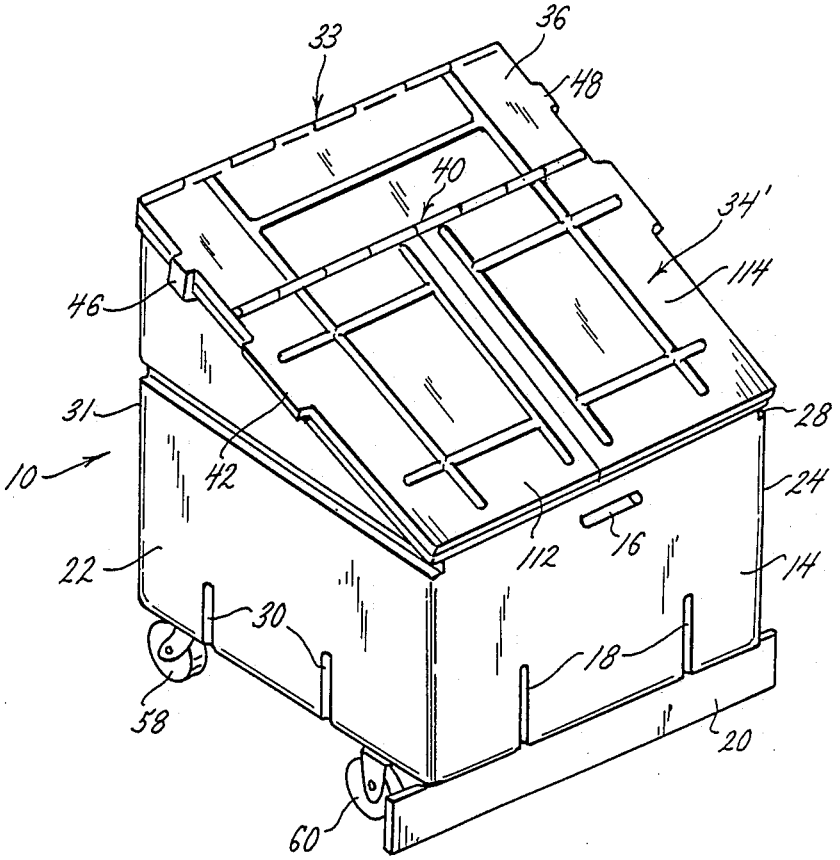
FIG. 9 is a perspective view of an additional embodiment of the transportable recycle container of the present invention.

Another embodiment of the invention shown in FIG. 9 provides a container lid 34' with a pair of separate forward lid members 112, 114 covering the left and right sides of the container top opening and arranged to cover the separated interior compartments of the container. Each lid member is pivotally connected to the rear lid member by the second hinge in the same manner as the forward lid member 38 of the first embodiment. The left and right side lid members are each responsive to a separate automatic lid opening mechanism positioned on opposite sides of the enclosure cavity 52 so that the left side 112 of the forward lid member is opened by opening the left door of the enclosure, and the right side 114 of the forward lid member is opened by opening the right door of the enclosure.

The enclosure assembly may be constructed entirely of wood as is conventional in the cabinet making art, but also may be constructed of stronger materials as are commonly used in industrial environments to support a work bench horizontal surface. In the preferred embodiment, the transportable recycle container 10 is constructed entirely of extrusion molded plastics; however, the recycle container may be constructed of other materials.

While the present invention has been described by reference to a specific embodiment, it should be understood that modifications and variations of the invention may be constructed without departing from the scope of the invention. For example, it is contemplated that various different types of mechanical connections may be employed to automatically raise and lower the container lid in response to opening and closing of an enclosure door other than the pivoting cam mechanism disclosed without departing from the scope of the invention defined in the following claims.

What is claimed is:

1. A container apparatus comprising:

a container having at least one generally vertical side wall and an interconnected bottom defining an interior of the container, the container being substantially fluid tight and having an opening at the container top;

a lid covering the top opening of the container and being adapted to be raised and lowered to open and close the top opening, respectively;

a first door, the container being adapted to be inserted into and removed from an enclosed area, the enclosed area being selectively opened and enclosed by the first door;

a pivot arm adapted to be pivoted about a stationary pivot point relative to the container, the pivot point of the pivot arm being fixed stationary relative to the enclosed area and the door, enabling the pivot arm to pivot relative to the area and the door; and a link member connected to the pivot arm and adapted to cause oscillating movement of the pivot arm about the pivot point in response to reciprocating movement of the link member, the link member having a first end connected to the pivot arm and a second end connected to the door, whereby the link member will reciprocate and cause the pivot arm to oscillate about the pivot point and open and close the lid of the container in response to opening and closing of the door.

2. The container apparatus of claim 1 comprising:

a plurality of rollers coupled for rotation to the bottom of the container, the rollers being adapted to convey the container.

3. The container apparatus of claim 2 comprising:
the pivot arm being a cam having a cam surface arranged to engage in sliding contact with the sliding surface of the lid.

4. The container apparatus of claim 3 comprising:
the link member and pivot arm being adapted to open the lid of the container in response to opening of the door connected to the second end of the link member, and the link member and pivot arm being adapted to close the lid of the container in response to closing of a door connected to the second end of the link member.

5. The container apparatus of claim 8 comprising:
a pair of mutually opposed vertical grooves provided in the interior of the container and a divider panel adapted to be inserted into and held vertically between the pair of grooves dividing the interior of the container into first and second separate compartments.

6. The container apparatus of claim 8 comprising:
first and second retainer rings adapted to be inserted into and to nest in openings of the first and second compartments formed by the divider panel inserted between the pair of grooves, the rings being adapted to hold open a receptacle positioned in each compartment and to suspend the receptacle from the opening to the compartment.

7. The container apparatus of claim 1 comprising:
two pairs of mutually opposed vertical grooves provided in the interior of the container and two divider panels, each panel being adapted to be inserted into and held vertically between a pair of grooves to divide the interior of the container into first, second and third separate compartments.

8. The container apparatus of claim 7 comprising:
first, second and third retainer rings adapted to be inserted into and to nest in openings of the first second and third compartments formed by the pair of divider panels, each inserted between a pair of the grooves, the rings being adapted to hold open a receptacle positioned in each compartment and to suspend the receptacle from the opening to the compartment.

9. The container apparatus of claim 1 comprising:
the lid begin connected to a back wall of the container by a releasable first hinge, the first hinge enabling the lid to pivot about the hinge to open and close the top opening of the container, and enabling the lid to be completely removed from the container.

10. The container apparatus of claim 9 comprising:
the lid having a second hinge parallel to the first hinge and extending across the lid dividing it into a forward and a rearward lid portion, the rearward lid portion having means to releasably secure it to the container over a rearward section of the container top opening and the forward lid portion being pivotable about the second hinge to selectively open and close a forward section of the container top opening.

11. The container apparatus of claim 10 comprising:
the forward lid portion having separate left and right side lid members, the left and right lid members being separately pivotable about the second hinge to selectively open and close a left and right side of the forward section of the container opening, respectively.

12. The container apparatus of claim 9 comprising:
a container enclosure substantially enclosing the enclosed area, the enclosure being dimensioned to receive the container and to hold the container stationary relative to the enclosure, the enclosure having a front opening providing access to the container when it is held in the enclosure, and the door being adapted to selectively open and close the front opening of the enclosure.

13. The container apparatus of claim 12 comprising:
a pivot pin secured stationary relative to the enclosure, the pivot arm pivotally mounted on the pivot pin and mechanically connected to the enclosure door, the pivot arm being adapted to engage the container lid enabling the pivot arm to raise and lower the lid in response to the opening and closing of the enclosure door, respectively.

14. The container apparatus of claim 8 comprising:
the pivot arm being mechanically connected to the enclosure door by the link member that reciprocates in first and second directions and pulls the pivot arm to pivot it upward and pushes the pivot arm to pivot it downward in response to opening and closing the enclosure door, respectively.

15. The container apparatus of claim 14 comprising:
the pivot arm being a cam having a cam surface adapted to slidably engage a surface of the lid, the cam surface sliding in a first direction across the surface of the lid causing it to be raised, and the cam surface sliding in a second direction across the surface of the lid causing it to be lowered, in response to upward and downward pivoting of the cam, respectively.

16. The container apparatus of claim 11 comprising:
a container enclosure substantially enclosing the enclosed area, the enclosure being dimensioned to receive the container and to hold the container stationary relative to the enclosure, the enclosure having a front opening providing access to the container when it is held in the enclosure, and the enclosure having a second door, the first and second doors selectively opening and closing a left and right half of the front opening, respectively.

17. The container apparatus of claim 16 comprising:
left and right pivot pins secured stationary relative to a left and right side of the enclosure and left and right pivot arms pivotally mounted on the left and right pivot pins, respectively, the left and right pivot arms being mechanically connected to the respective first and second doors, and being adapted to engage the left and right lid members, enabling each of the pivot arms to raise and lower its respective lid member in response to the opening and closing of its respective door.

18. The container apparatus of claim 17 comprising:
each pivot arm being mechanically connected to its respective door by link member that reciprocates in first and second directions and pulls the associated pivot arm to pivot it upward, and pushes the associated pivot rod to pivot it downward, in response to opening and closing the respective door.

19. The container apparatus of claim 18 comprising:
each pivot arm being a cam having a cam surface, the cam surface slidably engaging a surface of the lid member, the cam surface sliding in a first direction across the surface of the lid member causing the lid to be raised and the cam surface sliding in a second direction across the surface of the lid member causing the lid to be lowered in response to upward and downward pivoting of the cam, respectively.

20. A portable container and container enclosure assembly comprising:

a container having at least one generally vertical side wall and an interconnected bottom defining an interior of the container, the container interior being accessible through an opening at the container top;

a lid covering the container top opening, the lid being adapted to be raised to uncover the top opening, and lowered to cover the top opening;

a container enclosure having at least one opening and an interior volume dimensioned to receive the container through the enclosure opening;

a door adapted to be moved between a first and a second position relative to the enclosure opening, the door covering the enclosure opening in the first position, and the door uncovering the enclosure opening an enabling the container to be inserted into and removed from the enclosure interior through the enclosure opening in the second position;

a linkage means in the enclosure interior volume, the linkage means being mechanically connected between the container enclosure and the door, the linkage means being adapted to engage the container lid and raise the lid in response to the door being moved to its second position when the container and the lid are received in the interior volume of the enclosure.

21. The container and enclosure assembly of claim 20 comprising:

the linkage means being adapted to disengage the lid and cause the lid to lower and cover the container top opening when the container and lid are removed from the enclosure interior through the enclosure opening.

22. The container and enclosure assembly of claim 20 comprising:

the door being mechanically connected to the container enclosure by a hinge means at a side of the enclosure opening.

* * * * *